US007544253B2

(12) United States Patent
Kleiger et al.

(10) Patent No.: US 7,544,253 B2
(45) Date of Patent: Jun. 9, 2009

(54) METHOD AND APPARATUS FOR FLUSHING ASPHALT FEEDING DEVICES

(75) Inventors: Scott P. Kleiger, Harleysville, PA (US); Lewis Tarlini, Bensalem, PA (US)

(73) Assignee: Patch Management, Inc., Morrisville, PA (US)

( * ) Notice: Subject to any disclaimer, the term of this patent is extended or adjusted under 35 U.S.C. 154(b) by 11 days.

(21) Appl. No.: 11/879,623

(22) Filed: Jul. 18, 2007

(65) Prior Publication Data

US 2008/0035177 A1 Feb. 14, 2008

Related U.S. Application Data

(60) Provisional application No. 60/832,171, filed on Jul. 20, 2006.

(51) Int. Cl.
*B08B 7/04* (2006.01)
*E01C 19/12* (2006.01)

(52) U.S. Cl. ..... 134/10; 134/37; 134/98.1; 134/99.1; 134/198; 15/300.1; 15/304; 15/318; 15/320; 404/84.05

(58) Field of Classification Search ..... 134/22.12, 134/31, 34, 37, 10, 98.1, 99.1, 198; 15/320, 15/340.1, 340.2, 340.3, 300.1, 304, 318; 404/77, 79, 95, 4.05, 108
See application file for complete search history.

(56) References Cited

U.S. PATENT DOCUMENTS

| | | | | |
|---|---|---|---|---|
| 4,204,977 | A * | 5/1980 | Zwirlein | 422/133 |
| 4,695,186 | A * | 9/1987 | King | 404/111 |
| 6,000,413 | A * | 12/1999 | Chen | 134/102.2 |
| 2001/0035198 | A1 * | 11/2001 | Carawan et al. | 134/18 |
| 2006/0065293 | A1 * | 3/2006 | Sargent | 134/34 |

* cited by examiner

*Primary Examiner*—Michael Barr
*Assistant Examiner*—Saeed T Chaudhry
(74) *Attorney, Agent, or Firm*—Volpe and Koenig, P.C.

(57) ABSTRACT

A vehicle mounted patching system for patching potholes and the like and incorporating method and apparatus for removing and flushing asphalt emulsion from the feed lines of the patcher which completely recycles the cleaning agent used to flush the feed lines, as well as eliminating any external discharge of potentially toxic materials.

28 Claims, 9 Drawing Sheets

METHOD AND APPARATUS FOR FLUSHING ASPHALT FEEDING DEVICES

This application which claims the benefit of U.S. provisional application No. 60/832,171 and filing date of Jul. 20, 2006, which is incorporated by reference as if fully set forth.

FIELD OF INVENTION

The present invention relates to patching devices, and more particularly, to vehicle mounted patching systems for patching potholes and the like and incorporating method and apparatus for removing and flushing asphalt emulsion from the feed lines of the patcher which eliminates any external discharge.

BACKGROUND

Asphalt patching systems are well known in the art. For example, U.S. Pat. No. 5,263,790 issued Nov. 23, 1993 and U.S. Pat. No. 5,419,654 issued May 30, 1995, teach a patcher comprising a motor driven, wheeled vehicle having a gravel hopper and a storage tank for liquid asphalt, as well as pressurized conduits for respectively advancing gravel and asphalt to a mixing head. The asphalt emulsion is delivered from the storage tank to the mixing head by feed lines. The mixing head is arranged to extend from a free end of a swingably mounted, telescoping boom, which is moveable in both horizontal and vertical planes as well as being selectively extendable and retractable to expedite desired positioning of the mixing head above a roadway surface to be patched. The pressurized conduits may also be initially employed to blow debris from the pothole or crevice being patched whereupon asphalt, with or without aggregate, is delivered to the mixing head. The need for rolling or tamping is eliminated by the use of high-pressure air.

The feed lines carrying the asphalt emulsion must be cleaned on a regular basis, typically at least once per day.

Present day cleaning operations have the disadvantage of expelling a significant amount of asphalt emulsion and solvent during the cleaning process which constitutes an environmental hazard as far as safe disposal of the emulsion and solvent is concerned, as well as requiring means for collecting and storing the hazardous material and further requiring labor intensive activity in the performance of the cleaning operation. It is therefore desirable to provide method and apparatus for performing a cleaning operation which significantly reduces the labor intensive activity and, in one embodiment, substantially eliminates such labor intensive activity by performing the cleaning steps substantially automatically, as well as retaining the emulsion and solvent in the patcher and avoiding need for discharge of these materials during the cleaning operation and providing for continued reuse.

SUMMARY

The present invention is characterized by comprising method and apparatus embodiments for cleaning the asphalt emulsion feed lines of a patching system while eliminating any external discharge throughout the cleaning operation.

Feed lines providing asphalt emulsion to a mixing head, which is utilized to mix aggregate and the asphalt emulsion, are selectively fed emulsion and cleaned under control of a pair of four-position valves arranged adjacent to and preferably on opposite sides of the mixing head. When moved to a "patching" position, normal patching operations are performed i.e., asphalt is fed to the mixing head to perform patching.

By moving both valves to a "clearing" or "blowback" position, and opening a valve at the tank holding the asphalt emulsion, the ports of the pair of four-position valves enable high pressure air, preferably derived from the air brake system of the patcher, to enter the asphalt emulsion feed lines that are connected between the tank holding the asphalt emulsion and the mixing head. The pressure in the asphalt emulsion tank is lower than the entering pressure from the air brake system, whereby the asphalt emulsion in the feed lines is forced back to the asphalt storage tank, leaving only a small residue in the asphalt emulsion feed lines. If desired, the patching and clearing operations may be reversed in their order of performance.

The next step performed in the procedure is to close the conduit between the emulsion storage tank and the feed lines and place the pair of four-position valves adjacent to the mixing head in a third ("flushing") position which opens the ports to a conduit connected to a flush tank containing a solvent maintained under pressure. The valve at the asphalt emulsion tank is turned to the flush position, coupling the asphalt emulsion feed lines to the pressurized flush tank, which causes the cleaning agent to move through and flush the feed lines and valves, which feed lines include at least one section of clear hose coupled to a given port of one of the pair of control valves to facilitate observation of the progress of the flushing operation. The solvent flushes the feed lines as well as the pair of valves adjacent to the mixing head and the valve coupling the flush tank to the pair of valves. The solvent then flows out through given ports of the pair of valves into a recovery tank and is maintained in the recovery tank. The solvent is returned from the recovery tank to the flush tank by closing the line between the flush tank and the source of air pressure, and venting the flush tank to the atmosphere and opening the valve in the line between the flush tank and the recovery tank when the flush tank is depressurized, causing the solvent to return by the force of gravity to the flush tank. The flush tank is then sealed from the atmosphere and air supply valve is then opened to pressurize the flush tank in readiness for a subsequent flushing operation.

Pressurized air is drained out of the flush tank by opening an air bleed valve. When the pressure gauge of the flush tank reads "O" psi, the valve in the line coupling the recovery tank to the flush tank is opened to enable the cleaning agent to flow by gravity back into the flush tank. This valve remains open for approximately 2 to 3 minutes and is then closed. The flush valve adjacent to the flush tank is closed and the valve between the flush tank and the air pressure source is opened to re-pressurize the asphalt storage tank in readiness to perform a subsequent flushing operation, at which time the cleaning process is completed without removal of either asphalt or solvent from the patching system and thereby providing for recycling of both the asphalt and the solvent.

BRIEF DESCRIPTION OF THE DRAWING(S) AND PREFERRED EMBODIMENTS THEREOF

The embodiments of the present invention will be understood from a consideration of the detailed description and drawings, wherein like elements are designated by like numerals, and wherein.

DETAILED DESCRIPTION OF THE PREFERRED EMBODIMENT(S)

Figure 1A:
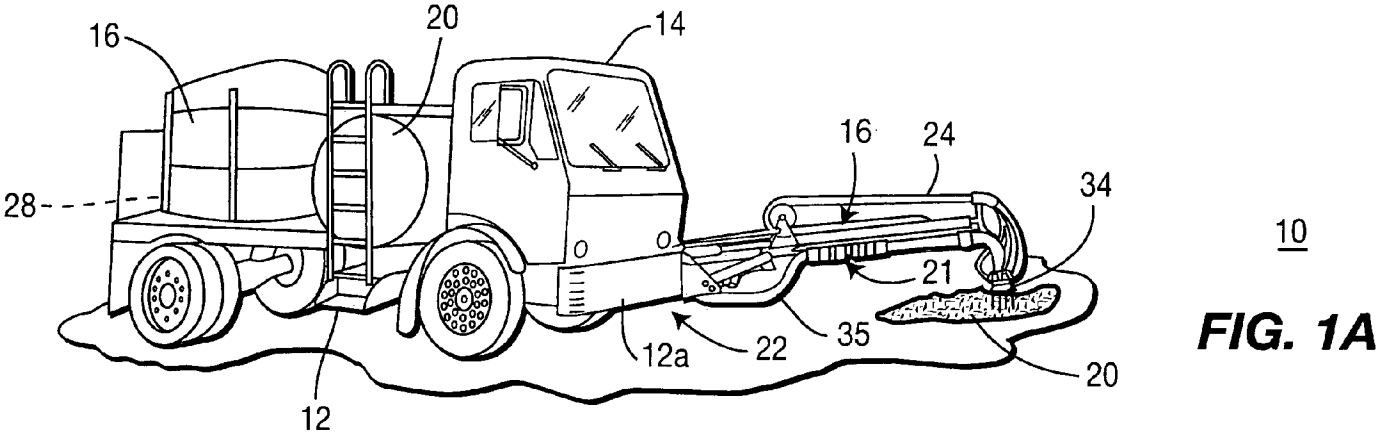
FIGS. 1A, 1B and 1C are perspective views of a patching vehicle embodiment utilizing the novel cleaning technique of the present invention.
Figure 1B:
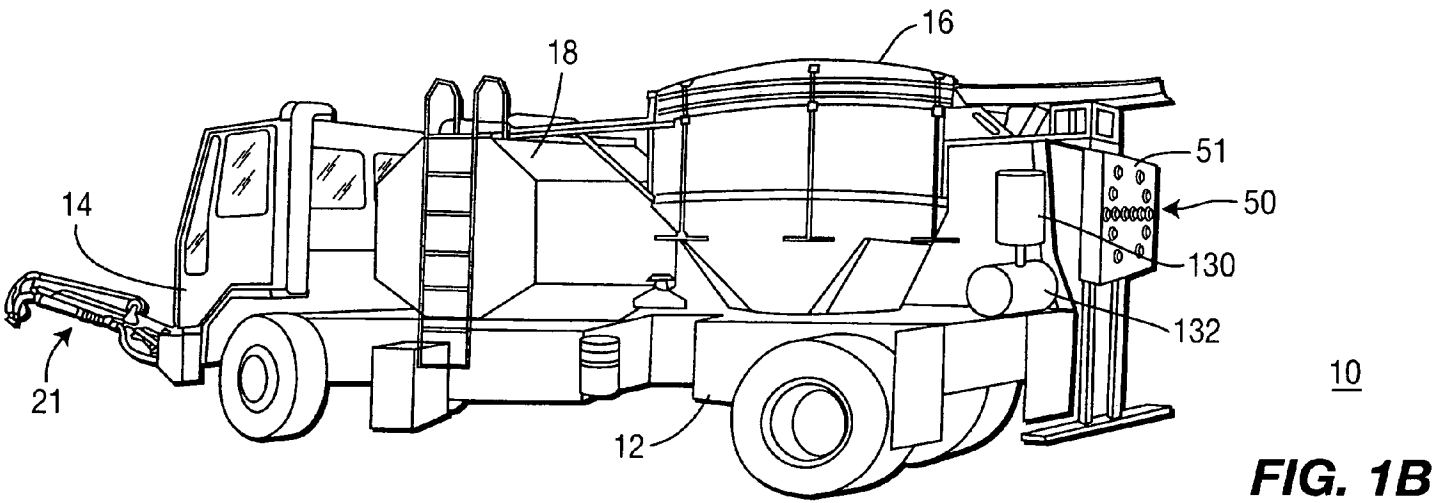
Figure 1C:
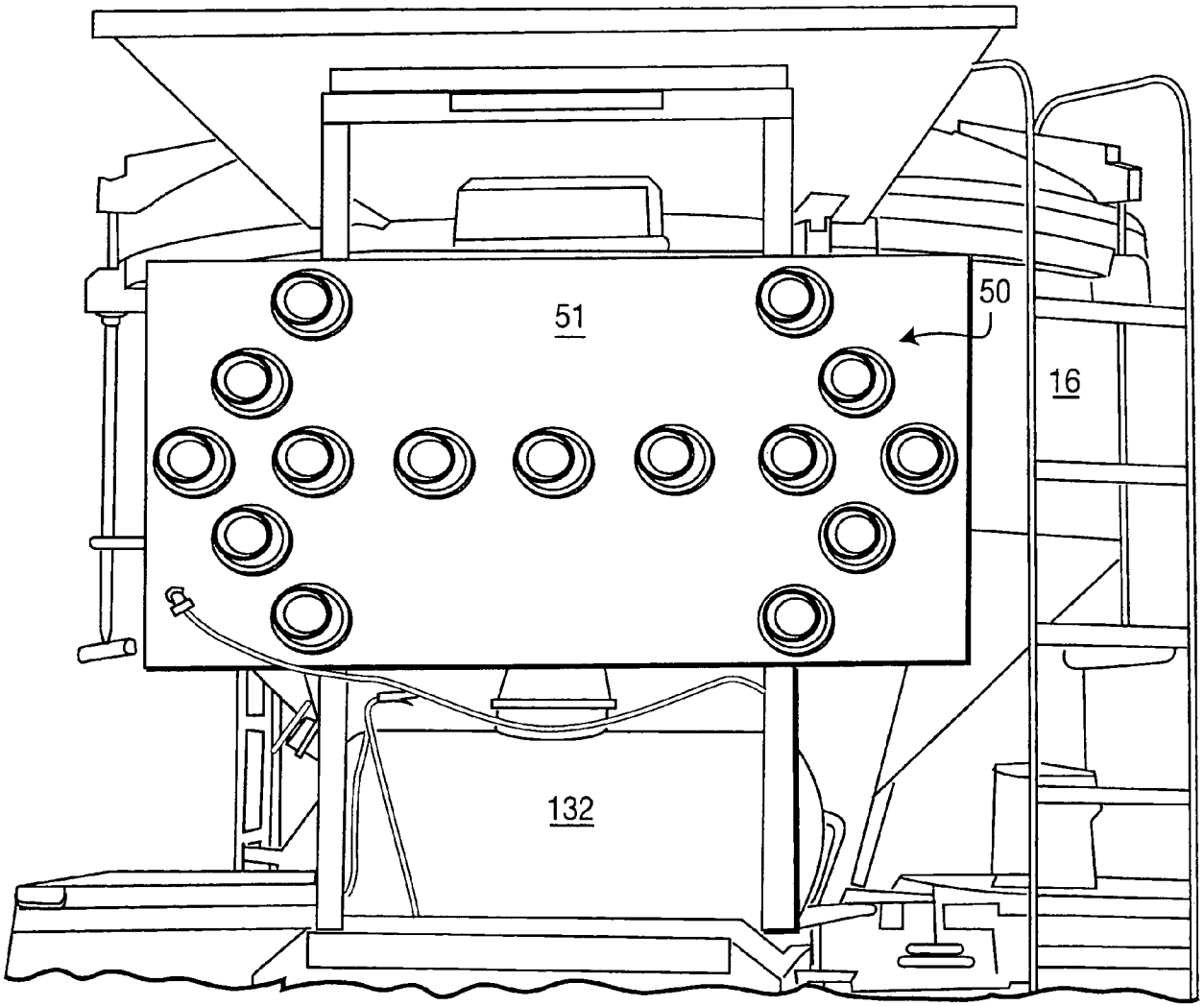

FIGS. 1A-1C are perspective views showing a vehicle (i.e., a "patcher") 10 for patching roadways and the like, typically through the use of an asphalt-gravel mixture and comprised of a wheeled, self-propelled vehicle including a chassis 12 and a cab, 14 containing the vehicle engine (not shown), which is any suitable engine employing an engine cooling system using liquid coolant (such as water or a water/anti-freeze mixture.)

Chassis 12 supports a gravel hopper 16 and an enclosure 18 of substantially hexagonal shape which contains an asphalt supply tank 20. The asphalt is normally heated to maintain a temperature of the order of 135 to 160 Degrees F.

Figure 2A:
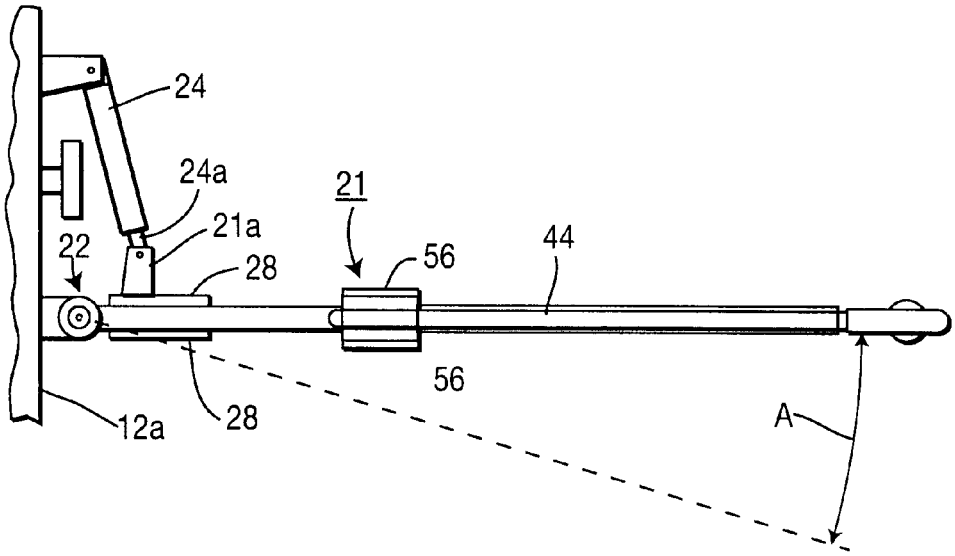
FIGS. 2A and 2B show the mixing head and boom of FIGS. 1A and 1B in greater detail.

A front boom assembly 21 is pivotally mounted to the front end of the cab 14 to enable the boom assembly to swing in a horizontal plane by means of pneumatic cylinder 24, shown in FIG. 2A. Boom assembly 21 is further swingable in a vertical plane under control of cylinder 26, detailed views of the boom assembly 21 and activating cylinders 24 and 26 being respectively shown in FIGS. 2A and 2B.

A flexible hose 35 communicates between gravel hopper 16 and a mixing head 34 arranged at the free end of boom assembly 21. Flexible hose 35 couples gravel hopper 16 to mixing head 34 through a telescoping delivery assembly 36.

The details of the movement of the boom assembly and its various components are set forth in U.S. Pat. No. 5,419,654 which is incorporated herein by reference and further details of the boom assembly and its operation are omitted herein for purposes of simplicity.

It is sufficient to understand, however, that a heated asphalt emulsion and aggregate are respectively fed to the mixing head under suitable air pressure as will be described in detail below.

The hollow, insulated non-collapsible hose 44 typically contains five (5) different fluid carrying lines as well as electrical wires as will be described below in greater detail. Non-collapsible hose 44 is maintained substantially taut regardless of the expansion or retraction of the telescoping delivery tube assembly 36, under control of piston cylinder 16, as is described in detail in the aforementioned issued U.S. Pat. No. 5,419,654.

FIG. 1C shows a rear view of patcher 12 which is provided with an array 50 of red lights mounted upon panel 51 which, when selectively illuminated, appear as left-hand and right-hand arrows to guide vehicles approaching from the rear to either the left or the right (or both the left and right) around the truck as it is performing patching operations. A flush tank 132 (to be more fully described), mounted on chassis 12, is shown just below the lower end of panel 51. A recovery tank 130 (not shown in FIG. 1C), is positioned above flush tank 132. See also FIGS. 3 and 3C.

Figure 3:
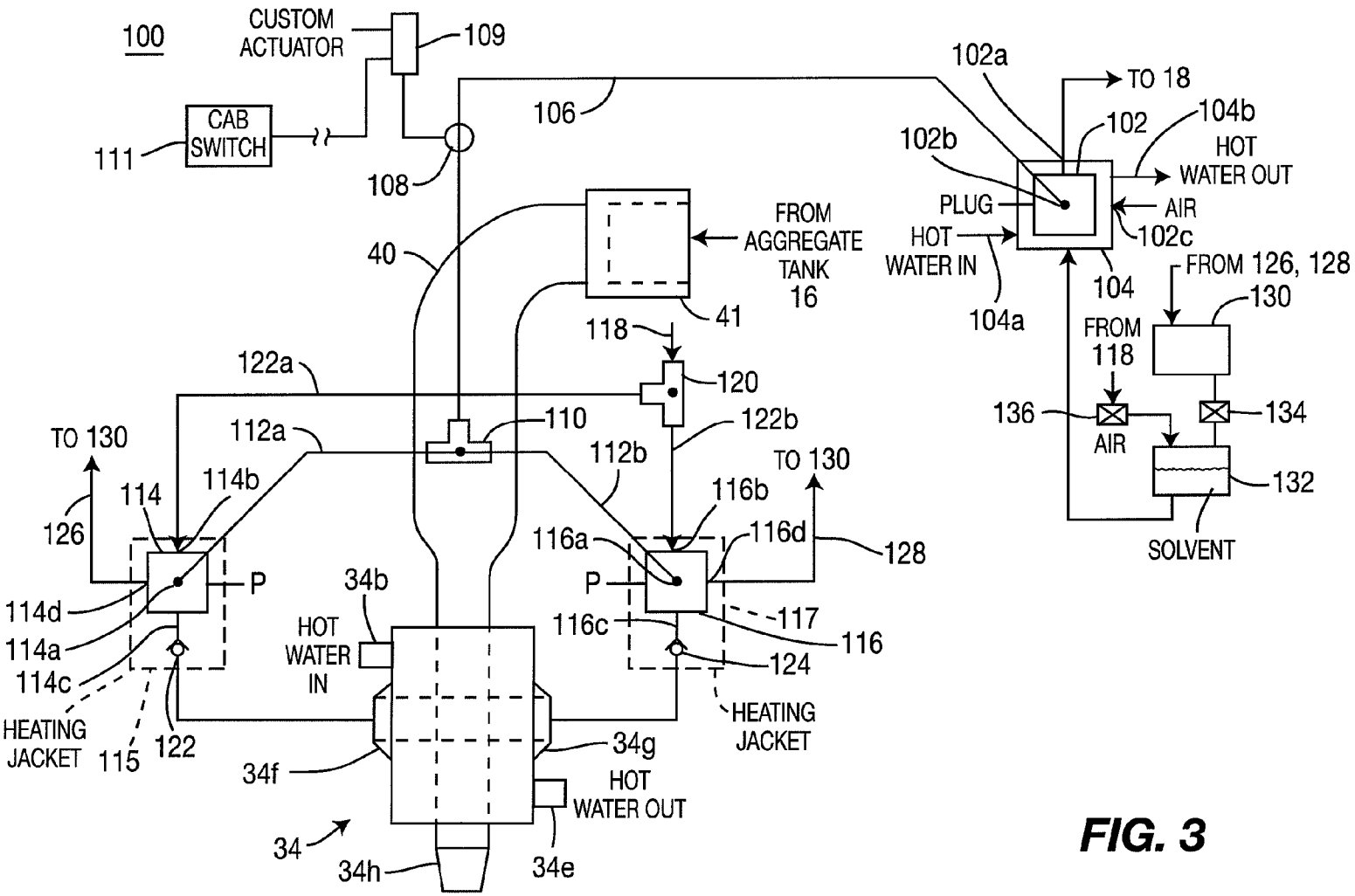
FIG. 3 is simplified schematic diagram embodying the principles of the present invention and which is useful in describing the cleaning procedure of the present application.

FIG. 3 shows a simplified schematic diagram which is useful in explaining the normal patching operations and especially the manner in which the feed lines carrying asphalt emulsion are emptied of emulsion and flushed by a solvent, both of which materials are fully recycled, thereby totally avoiding the need to drain any of the emulsion residue or solvent employed in the flushing operation. In other words, a fully self-contained system is provided for performing the cleaning and flushing operations and no fluids or residue are emitted nor do they leave the self-contained system during the performance of the air cleaning and flushing operations.

Figure 2B:
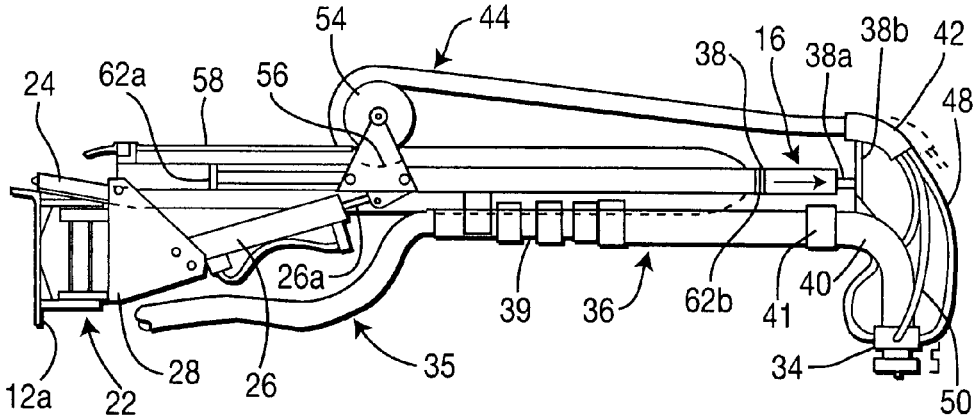

As was described above, the aggregate hopper 16 is coupled to the mixing head 34 by means of the telescoping assembly 36 also shown, for example, in FIG. 2B and provided at its free end with curved tube 40 joined to the telescoping assembly 36 by coupling collar 41. Coupling collar 41 and the curved tube member 40 are shown in FIG. 3 wherein aggregate from hopper 18 passes through coupling 41 and curved tubing 40 and enters into the hollow interior 34*a* of mixing head 34 with the aid of pressurized air.

Figure 3A:
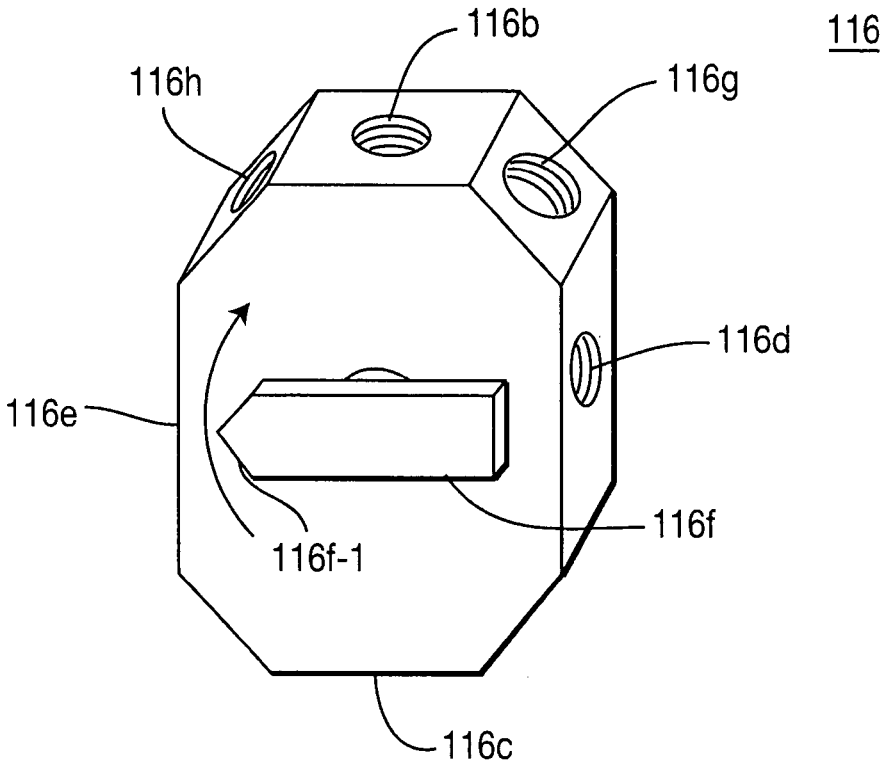
FIG. 3A is a detailed perspective view of one of the multi-position control valves shown in FIG. 3.
Figure 3B:
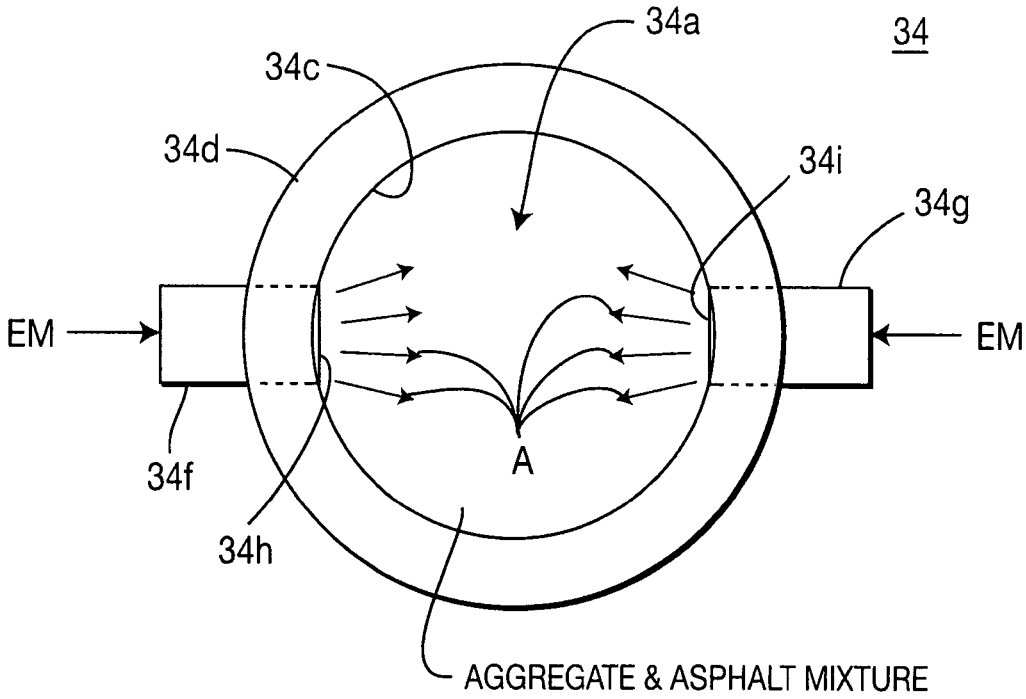
FIG. 3B is a sectional view of the mixing head looking in the direction of arrows 3B-3B in FIG. 3.

Coolant from the engine cooling system of the patcher 10, which is typically heated to a temperature in the range of 135-160 of 150 degrees F., enters into a hot water inlet coupling 34*b* and circulates through the hollow interior of the mixing head defined by the inner and outer cylinder walls 34*c* and 34*d*, shown in FIG. 3B, leaving the mixing head by way of coupling outlet 34*e* which returns the cooling fluid through a suitable conduit to the engine radiator, not shown, and forming part of the engine cooling system employed for driving the vehicle which is also not shown for purposes of simplicity.

The emulsion storage tank 18 is coupled to an inlet port 102*a* of a multi-port valve 102 having a common outlet port 102*b* which is selectively coupled to one of the ports respectively arranged at 3 o'clock, 6 o'clock, 9 o'clock and 12 o'clock positions about the sidewalls of valve 102. Valve 102 is preferably enclosed within an insulating jacket 104 having inlet and outlet ports 104*a* and 104*b* for respectively introducing hot water from the engine cooling system into jacket 104 and for returning the hot water to the engine cooling system. The hot water flowing through jacket 104 maintains asphalt emulsion passing through valve 102 in a heated, flowable condition to prevent clogging of the valve.

When valve 102 is moved to the position coupling 12 o'clock port 102*a* to common port 102*b*, heated asphalt from tank 18 passes through valve 102 and enters asphalt line 106, which is one of the lines that is enclosed within the hollow, insulated non-collapsible hose 44, shown in FIG. 2B.

A valve assembly, preferably a one-half inch (0.50") ball valve assembly 108, is connected in line 106 and is operated under the control of a custom linear actuator 109 operated under control of an actuator switch 111 located in the patcher cab 14 to provide an adjustable flow rate of the asphalt emulsion through line 106. Line 106 is split by a T-coupler 110, providing a first branch 112*a* which is coupled to the common port 114*a* of control valve 114 and a second branch 112*b* coupled to common port 116*a* of control valve 116.

Multi-position control valves 114 and 116, as well as valve 102, are substantially identical in design and function, as will be more fully described in connection with FIG. 3A. Valves 102, 114 and 116 are each respectively enclosed within a heating jacket 104, 115, 117 each of which are electrically heated to maintain the asphalt emulsion in heated, flowable state and thereby prevent freezing of asphalt in these valve structures when patcher 10 is shut down and stored overnight or during weekends, in cold temperature regions, by coupling the electrically operable heating jackets to a suitable power source (not shown).

FIG. 3A is a perspective view of one of the four-position control valves, such as valve 116, it being understood that both control valves 114 and 116 (as well as valve 102) are substantially identical in design and function, and it being further understood that the positions of the outlet ports of valves 114 and 116 in FIG. 3 are symmetrical about an axis of symmetry which is coaxial with a central axis of mixing head 34. Only one control valve will be described in detail for purposes of simplicity.

The control valve 116 shown in FIG. 3A is a substantially solid block provided with ports 116*b*, 116*d*, 116*c* and 116*e*, respectively arranged at 12 o'clock, 3 o'clock, 6 o'clock and 9 o'clock positions around the top, right-hand, bottom, and left-hand side surfaces of the control valve. An operating handle 116*f* is mounted along the front face of the control valve and may be selectively positioned in one of the 12, 3, 6 and 9 o'clock positions. The control valve 116 is provided with a common inlet opening 116*a* along its rear surface. By positioning the control valve operating handle so that its tapered shape tip 116*f*-1 is aligned with one of the four (4) given positions 116*b*-116*e*, that port communicates with common port 116*a* in accordance with the alignment of the rotatable operating handle 116*f*.

The valve assembly 116 comprises a hollow housing and is further provided with a pair of openings 116*g* and 116*h* along respective diagonal side surfaces for receiving coolant from the patcher engine cooling system to heat the valve and thereby maintain asphalt passing through the control valve 116 during a patching operation to be in a heated, flowable state and thereby prevent the control valve 116 (as well as control valves 114 and 102) from becoming clogged with cooled emulsion.

An air supply line 118 derives air under pressure directly from the air brake supply of the patcher air brake system (i.e., without any reduction in pressure), not shown for purposes of simplicity. Air pressure of the order of 120 psi is supplied to the air line 118. A T-coupler 120 feeds the pressurized air to branch lines 122*a* and 122*b*, each of which are respectively coupled to inlet ports 114*b* and 116*b* of multi-position valves 114 and 116.

Ports 114*c* and 116*c* of multi-position valves 114 and 116 are respectively coupled through one-way valves 122 and 124 to one of the inlets 34*f* and 34*g* which extend through outer and inner jacket walls 34*c* and 34*d* of mixing head 34 (see FIG. 3B) in order to introduce asphalt emulsion at diametrically opposed openings provided along the inner and outer jackets 34*c* and 34*d* and thereby introduce asphalt emulsion into the hollow interior of the mixing head 34. Suitable dispersing members 34*h* and 34*i*, shown in FIG. 3B, are substantially flush with the interior jacket 34*c*, to disperse the asphalt emulsion throughout the hollow interior of the mixing head, as shown by arrows A, to coat the aggregate fed into mixing heat 34.

As was previously mentioned, the aggregate passes through curved member 40 and into the hollow interior of mixing head 34 where the aggregate is admixed with and coated by the liquid emulsion and then passed through the outlet end 34*h* of the mixing head 34 for deposit into a pothole or other crevice or recess being and/or repaired. As was mentioned above, air under pressure may be introduced into mixing head 34 while the emulsion feed lines and aggregate line are closed, to clean debris from a pothole. Also, air under pressure enters the flexible hose 35 and telescoping assembly 36 to advance the aggregate into the mixing head 34.

Check valves 122 and 124 are preferably respectively coupled between outlet ports 114*c* and 116*c* and couplings 34*f* and 34*g*, allowing emulsion to pass in only one direction and enter into the mixing chamber of mixing head 34 while preventing any reverse flow of the asphalt emulsion from the mixing head back into the control valves 114 and 116 through ports 114*c*, 116*c*.

The one-way check valves 122 and 124 are preferably provided with jackets having inlet and outlet ports similar to the ports 116*g* and 116*h* of valve 116, as shown in FIG. 3A, to receive coolant to heat the check valves during patching operations. For simplicity, check valves 122 and 124 are shown as being enclosed within the heating jackets 115 and 117, but may be provided with their own heating jackets, which maintain any asphalt emulsion within the jackets in the heated, flowable state regardless of the ambient temperature and thereby prevent the one-way valves from becoming clogged with cooled emulsion. Check valves 115 and 117 have a housing provided with inlet and outlet openings similar to the openings 116*g*, 116*h* provided in housing 116 shown in FIG. 3A, to receive coolant to heat the check valves and hence the emulsion flowing therethrough in the same manner as valve 116.

Control valves 114 and 116 are further provided with outlet ports 114*d* and 116*d*. Back flush conduits 126 and 128 are coupled between ports 114*d*, 116*d* and recovery tank 130. Flush tank 132 contains solvent under pressure, employed for flushing the feed lines 106, 112*a* and 112*b*. Recovery tank 130 is located above flush tank 132 to provide for the flow of fluid by gravity from recovery tank 130 to flush tank 132, when normally-closed valve 134 is open. The solvent is typically diesel fuel but may be any other suitable cleaning agent having like cleansing and/or flushing capabilities.

Patcher 10 operation is initialized by assuring that air pressure provided to the asphalt storage tank 18 and the flush tank 132 are within the range of 50-70 psi and that the air brake system is developing air pressure in the range of 100-120 psi. Valve 136, coupled near the outlet of the air brake pressure source, is a regulator valve which, when open, regulates the output pressure introduced into the flush tank 132 and the asphalt storage tank 18, through valve 102, to obtain the desired pressure levels mentioned above. Valves 114 and 116 are then placed in the 12 o'clock position, causing air entering 122*a* and 122*b* to pass through valves 114 and 116 and enter into the feed lines 112*a* and 112*b*. The air brake pressure source fed to the line 118 bypasses the valve 136 and thus provides maximum pressure (i.e., 100-120 psi) to the 12 o'clock ports of valves 114 and 116 to clear line 106. Valve 102 is then placed in the 12 o'clock position. The actuator switch 111 in the patcher cab 14 (see FIG. 3) is operated to activate linear actuator 110 and open ball valve 108. Air blows through the valves 102, 114, 116, and feed lines 112*a*, 112*b* and 106, clearing valves 102, 114 and 116 and feed lines 106, 112*a* and 112*b* of any emulsion. The air pressure in the feed lines drops after 1-2 minutes. The pressure is monitored by a pressure gauge (not shown) in cab 14. The ball valve 108 is then closed by operating switch 111. Thereafter, both valves 114, 116 are moved to the 6 o'clock position in readiness for a patching operation. Emulsion may take approximately 30 seconds to flow to mixing head 34 since air may still be in the feed lines.

During a typical patching operation, a pothole in the roadway surface is cleaned by blowing high-volume air into the pothole. Air under pressure is introduced into feed line 106 by placing valve 102 in the 3 o'clock position (see port 102*c* which recieves air) and placing valves 114 and 116 in the 6 o'clock position to emit air from dispencing head 34. Thereafter, a tack coat of emulsion may be applied to the area to be treated. Thereafter, a mixture of aggregate coated with heated emulsion is emitted from the mixing head 34 to fill the pothole. The valve 102 is then placed in the 12 o'clock position and valves 114 and 116 are placed in the 6 o'clock position to cause emulsion to flow (under pressure) from the supply tank 18 to mixing head 34 through 102, 106, 112*a*, 112*b* 114, 116 and 122, 124. A finished coat of dry aggregate may then be applied, if desired. The 3 o'clock port of valve 102 can also receive air to blow out the feed line 106, if desired. It has been found that sprayed injection patching is the most economical and longest lasting method for pothole repair.

In order to clean the internal lines of asphalt emulsion while at the same time eliminating any external discharge of fluid from the system and completely recycling the asphalt and solvent, control valves 102, 114 and 116 are operated in the following manner:

A shut-down storage operation is initiated by introducing air into the feed lines by operating switch 111 in cab 14 to fully close the ball valve 108. The operating handles of control valves 102, 114 and 116 are respectively moved to the 3 o'clock, 12 o'clock and 12 o'clock positions. Ball valve 108 is then opened and maintained open for approximately 1 to 2 minutes until the air pressure in the feed lines drops (monitored by the aforementioned air gauge in cab 14) whereupon the ball valve 108 is fully closed.

Valves 114 and 116 are then respectively moved to the 9 o'clock and 3 o'clock positions. Control valve 102 is then moved to 6 o'clock position, coupling flush tank 132 to feed line 106 through ports 102*d*, 102*a* of valve 102 in readiness to perform a flushing operation. Actuator 109 is operated to open ball valve 108, causing solvent in pressurized flush tank 132 to enter the 6 o'clock port of valve 102 and pass through valve 102, feed lines 106, 112*a* and 112*b* and valves 114 and 116 and then to recovery tank 130 through back flush lines 126 and 128. One of these hoses, such as hose 128, is preferably formed of a clear transparent material, enabling an operator to view the cleaning agent as it moves from flush tank 132, through valve 102, feed lines 106, 112*a*, 112*b*, valves 114 and 116 and back flush lines 126, 128 and enter into recovery tank 130, shown in FIGS. 1C, 3, 3C and 3D. The asphalt is cleansed from line 106 and valves 114, 116 by the cleaning agent as can be viewed passing through the clear hose 128. The ball valve 108 is then returned to the closed position.

Figure 3C:
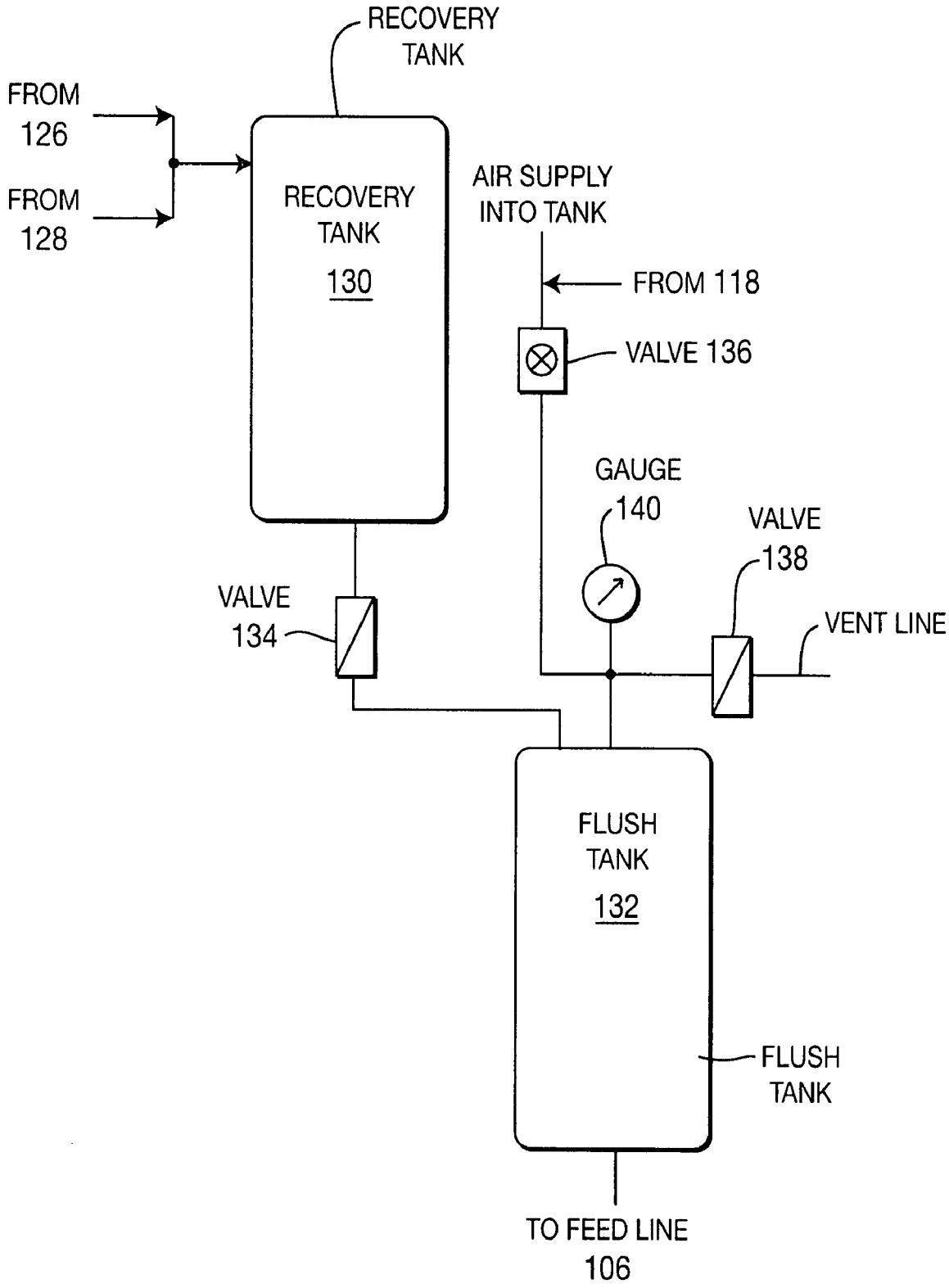
FIGS. 3C and 3D are perspective and simplified schematic views of the flush and recovery tanks shown in FIG. 3.
Figure 3D:
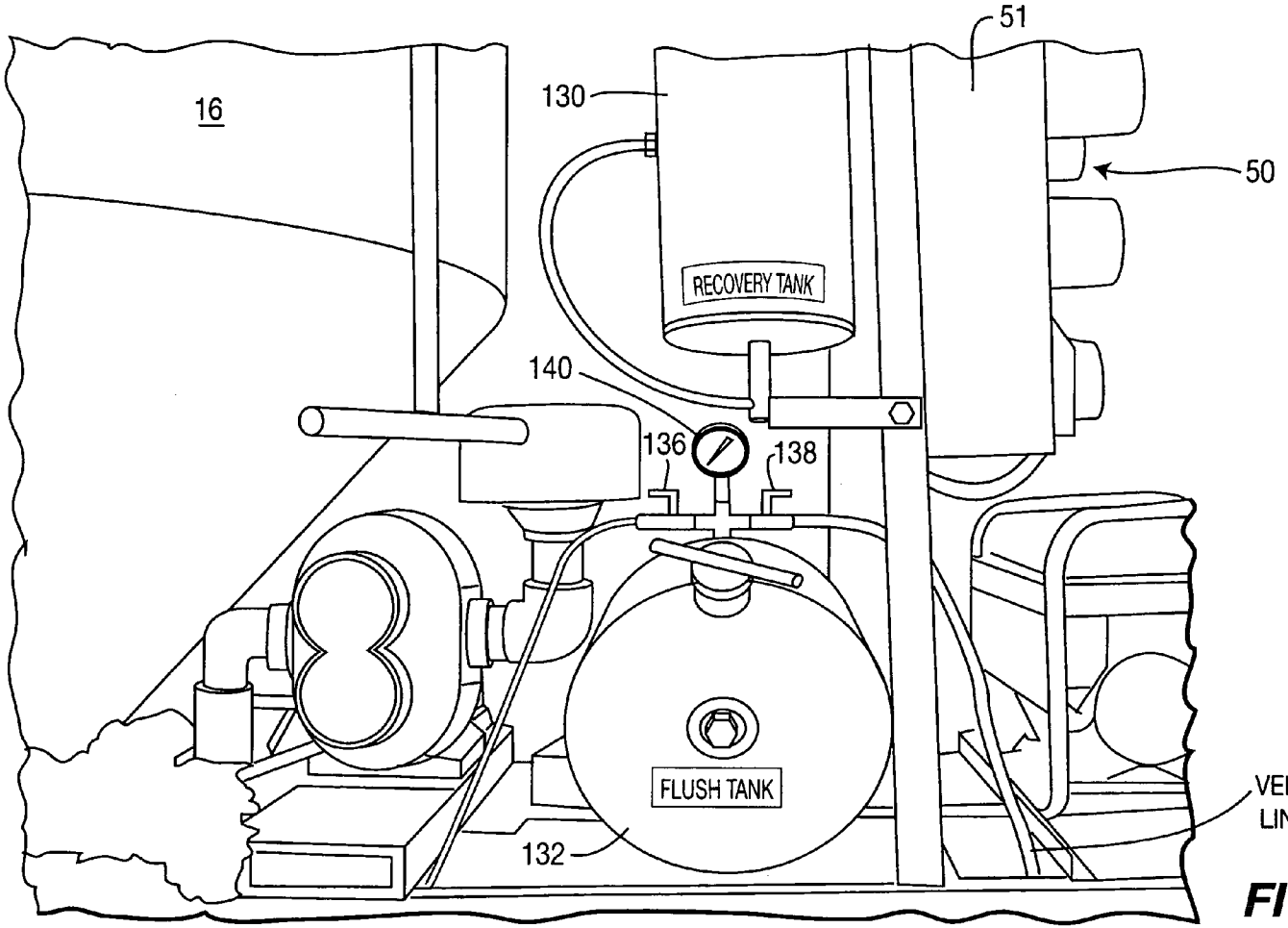

The cleaning agent is returned to flush tank 132 from recovery tank 130 by respectively moving valves 114 and 116 to the 3 o'clock and 9 o'clock positions and closing valve 102 (by moving valve 102 to the 9 o'clock position). The air supply line to flush tank 132 and to the emulsion tank 18 is closed by closing valve 136. The air under pressure in flush tank 132 is vented to the atmosphere by opening valve 138 as shown in FIG. 3C. When the reading of pressure gauge 140 reads "0" (zero) psi, flush tank 132 is now relieved of air pressure.

Closed valve 134 is then opened for 2-3 minutes to drain the recycled cleaning agent, delivered to recovery tank 130 by lines 126 and 128, back into flush tank 132 and valve 34 is then closed.

The air pressure release valve 138 which bleeds air from tank 132 to the atmosphere is closed and valve 136 is opened to repressurize tank 132 and emulsion supply tank 18 from pressure source 118, completing the back flush operation and retaining all of the solvent and emulsion in the closed system. The connections for the flush operation may be reversed by coupling the flush tank 132 to valves 114 and 116 and coupling the recovery tank 130 to valve 102.

Figure 3E:
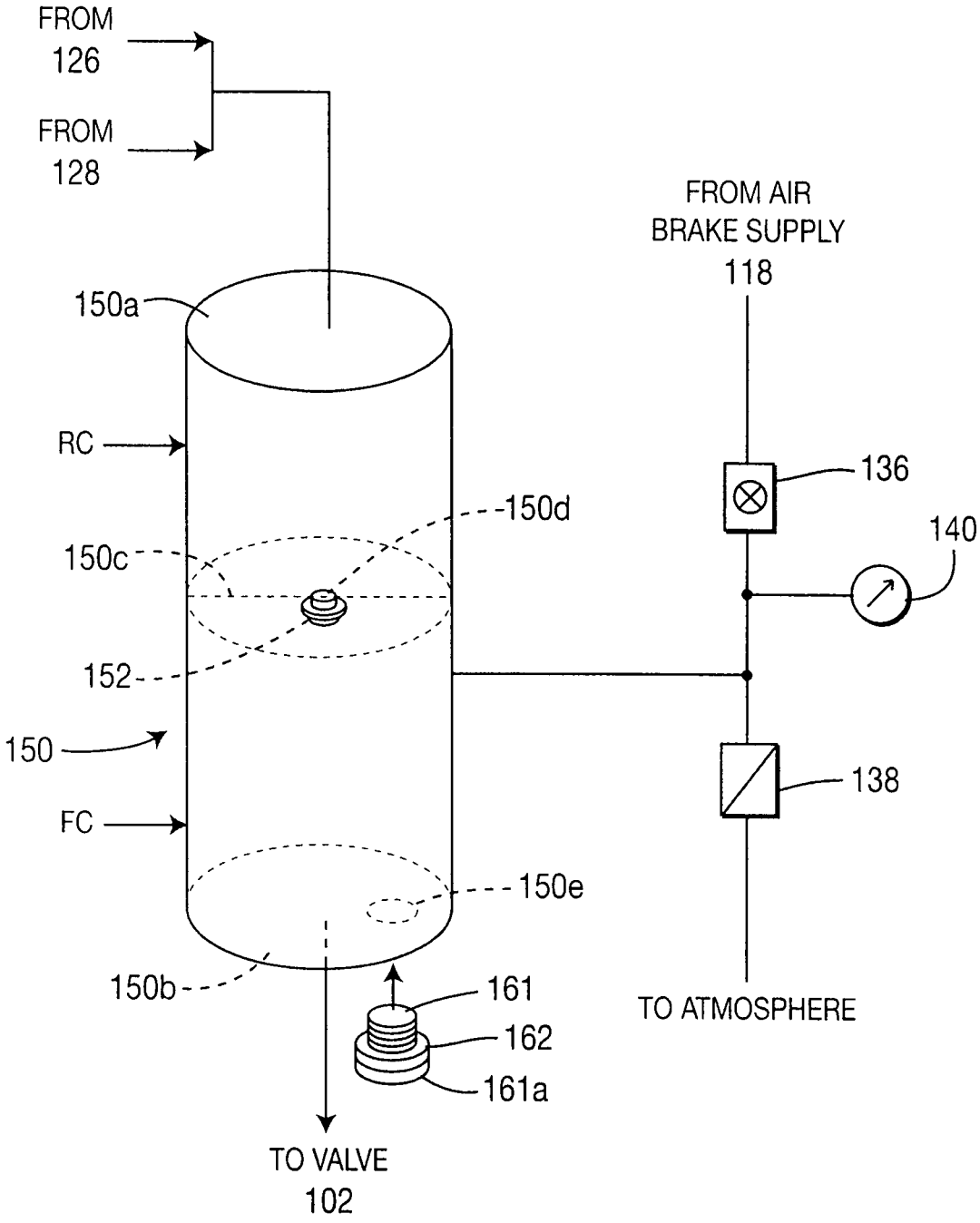
FIGS. 3E, 3F and 3G are schematic, sectional and plan views showing another solvent handling embodiment of the present invention.
Figure 3F:
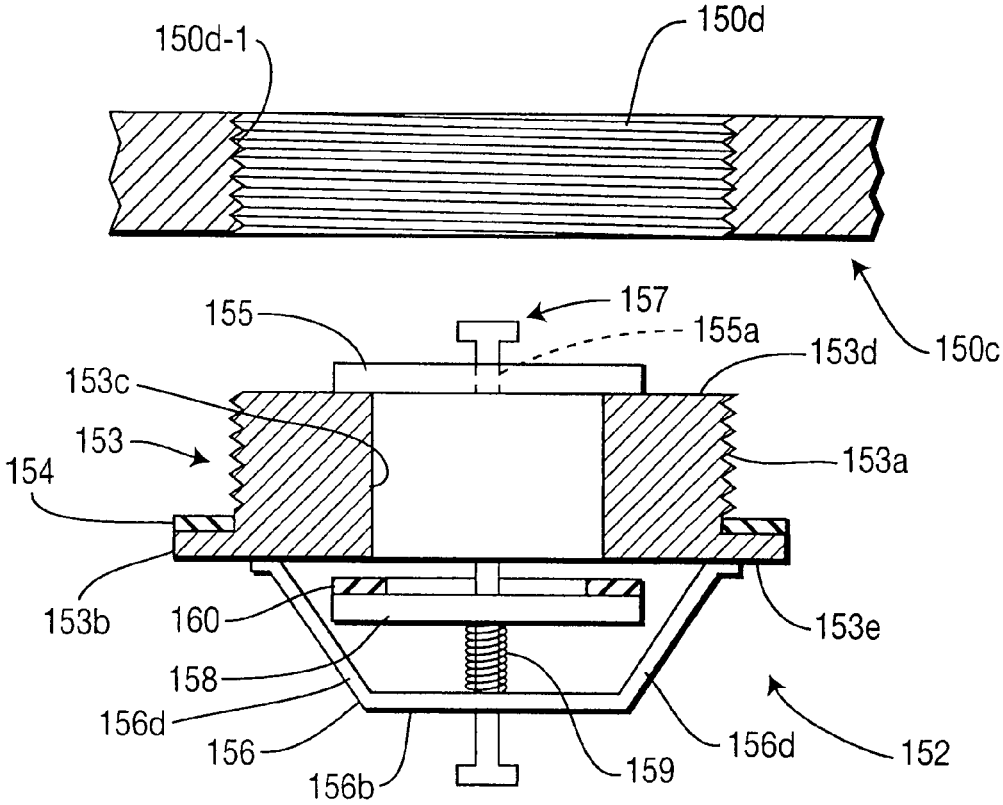
Figure 3G:
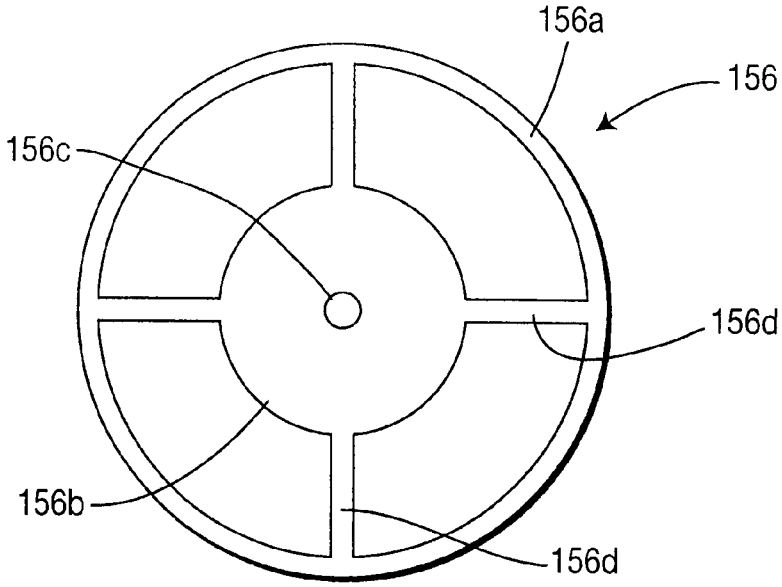

FIGS. 3E, 3F and 3G show another solvent handling embodiment in which recovery tank 130, valve 134 and flush tank 132 are replaced by a single tank 150, which has an internal barrier 150*c* intermediate the upper and lower ends 150*a*, 150*b*, to define a recovery compartment RC and a flush compartment FC. Tank 150 is a rugged steel tank which provides an air-tight interior. A poppet valve assembly 152 is arranged in a central opening 150*d* in barrier 150*c*. The assembly 152, shown in detail in FIG. 3F, is comprised of an annular threaded member 153, which is threaded as shown at 153*a* along its outer periphery and threadedly engages a threaded bore 150*d*-1 in barrier opening 150*d*. Annular flange 153*b* engages a marginal portion surrounding opening 150*d* when the threaded member 153 is inserted into opening 150*c*. An annular, resilient compressible gasket 154 is preferably positioned between barrier 150*c* and flange 153*b* to provide an air-tight seal when threaded member 153 is tightened. A disk 155 and a spider 156 are respectively joined to upper and lower surfaces 153*d*, 153*e* of threaded member 153. Disk 155 has an opening 155*a*. Spider 156 comprises an outer ring 156*a* joined to surface 153*e*. A centrally located, disk-shaped portion 156*b* has an opening 156*c* and is joined to ring 156*a* by radially aligned members 156*d*, opposite ends of which are integrally joined to ring 156*a* and disk portion 156*b*. A rod 157 extends through and is slidably guided by openings 155*a*, 156*c*. A sealing disk 158 is secured to rod 157 to selectively seal opening 153*c*. Rod 157 extends through a helical spring 159 which is positioned between sealing disk 158 and disk portion 156*b*. Spring 159 normally urges sealing disk 158 into light sealing engagement with member 153. A gasket 160 arranged between member 153 and sealing disk 158 enhances the air-tight seal.

When the pressure in the lower half FC of tank 150 is greater that in the upper half RC of the tank, poppet valve 152 is urged in an upward direction by the force of the pressure in compartment FC, to firmly seal the lower compartment and thereby maintain the cleaning agent in the lower half of tank 150 under pressure. During the flushing operation, the cleaning agent under pressure flows from the lower half of tank 150 to valve 102 when it is in the flush position.

When the flush operation is completed, the valve 136 is closed and the valve 138 is opened to bleed air from the lower half of tank 150. The force of the solvent collected in upper compartment RC is greater than the spring force of spring 159, urging sealing disk downwardly, enabling the cleaning agent to automatically return to the lower compartment of tank 150. When the cleaning agent has been drained from the upper compartment, the spring force of spring lightly urges sealing disk 158 to the sealed position. Valve 138 is closed and valve 136 is opened thereby repressurizing the flush compartment FC of tank 150 (containing the cleaning agent) in readiness for a subsequent flushing operation. In order to retain the air-tight integrity of tank 150, a threaded opening 150*e* is provided along the bottom end 150*b* of tank 150 to facilitate insertion and maintenance of poppet valve assembly 152. The threaded opening 150*e* is sealed by threaded plug 161, having a flange 161*a* which engages a marginal portion of bottom end 150*b* surrounding opening 150*e*. A gasket 162 is preferably arranged between flange 161*a* and the bottom end 150*b* of tank 150.

The invention claimed is:

1. For use by a wheeled unit for repairing roadway surfaces with a heated repair material, delivered from a storage tank through a first valve at an output of the storage tank, a feed line and at least a second multi-position valve to a mixing and dispensing head, a method for clearing and flushing the feed line, comprising:

a) moving the first valve to a first position coupling the feed line to the storage tank;

b) moving the second valve to a blowout position to couple a pressurized air line to the feed line, causing the heated repair material in the feed line to return to the storage tank;

c) moving the first valve to a second position decoupling the storage tank from the feed line and coupling the feed line to a flush tank containing a cleaning agent under pressure; and d) moving the second valve to a flush position decoupling the air line from the feed line and coupling the feed line to a recovery tank, whereby cleaning agent from the flush tank flushes the feed line and is collected in the recovery tank for return to the flush tank.

2. The method of claim 1, wherein step (a) further comprises:

e) closing an adjustable valve provided in the feed line to adjustably regulate the flow of the heated repair material to the mixing and dispensing head prior to moving the first valve to the first position; and wherein step (b) further comprises:

opening the adjustable valve to enable the pressurized air to blow the heated repair material in the feed line back into the storage tank.

3. The method of claim 1, further comprising:

opening an air release valve coupled between the flush tank and a vent line to release pressurized air in the flush tank; and opening a valve coupled between the flush tank and the recovery tank, causing cleaning agent collected in the recovery tank to return to the flush tank.

4. The method of claim 3, further comprising:

closing the valve between the flush tank and the recovery tank; and introducing air pressure into the flush tank to pressurize the cleaning agent in readiness for a subsequent flushing operation.

5. For use by a wheeled unit for repairing roadway surfaces with a heated repair material, delivered from a storage tank through a first valve at an output of the storage tank, a feed line containing a flow rate valve and at least a second multi-position valve selectively coupled to a mixing and dispensing head, a method, comprising:

a) closing the flow rate valve:

b) moving the first valve to a first position decoupling the storage tank from the feed line and coupling the feed line to an air pressure line;

c) moving the second multi-position valve to a patching position to couple the feed line to the mixing head;

d) opening the flow rate valve to enable air pressure from the air pressure line to clear the feed line, second multi-position valve and mixing head preparatory to a repair operation;

e) closing the flow rate valve and moving the first valve to a second position coupling the storage tank to the feed line and decoupling the air line from the feed line; and f) opening the flow rate valve, causing the heated repair material to flow into the mixing head.

6. A method for flushing a feed line which feeds asphalt from a source of asphalt to a dispensing device, comprising:

disconnecting the feed line from the dispensing device;

blowing air into a downstream end of the feed line to return asphalt in the feed line to said source;

feeding a cleaning agent from a pressurized flush tank into the upstream end of the feed line; and collecting the cleaning agent leaving the feed line in a recovery tank for subsequent reuse by the flush tank and to thereby prevent external discharge of the cleaning agent.

7. The method of claim 6 further comprising:

depressurizing the flush tank;

coupling the recovery tank to the flush tank to return the collected cleaning agent to the flush tank; and repressurizing the flush tank in readiness for a subsequent flushing operation.

8. The method of claim 6, further comprising:

opening a vent valve to depressurize the flush tank;

coupling the recovery tank to the flush tank by opening a coupling valve between the recovery tank and the flush tank to return the collected cleaning agent to the flush tank; and closing the vent valve and coupling valve and repressurizing the flush tank in readiness for a subsequent flushing operation.

9. Apparatus for flushing a feed line which feeds asphalt from a source of asphalt to a dispensing device, comprising:

a first valve for disconnecting the feed line from the dispensing device and connecting the feed line to a recovery tank;

a second valve for decoupling the feed line from said source of asphalt and connecting the feed line to a flush tank containing a cleaning agent under pressure, whereby the cleaning agent flushes the feed line and is collected in a recovery tank, thereby fully recycling the cleaning agent.

10. Apparatus for use by a wheeled unit for repairing roadway surfaces with a heated repair material, comprising:

a source delivering repair material through a first multi-position valve at an output of the storage tank, a feed line and at least a second multi-position valve to a mixing and dispensing head;

said first multi-position valve having a first position coupling the feed line to the storage tank;

said second multi-position valve having a blowout position coupling a pressurized air line to the feed line, causing repair material in the feed line to be returned to said source;

said first multi-position valve having a second position decoupling the storage tank from the feed line and coupling the feed line to a flush tank containing a cleaning agent under pressure; and said second multi-position valve having a flush position decoupling the air line from the feed line and coupling the feed line to a recovery tank, whereby cleaning agent from the flush tank flushes the feed line and is collected in the recovery tank for subsequent return to the flush tank.

11. The apparatus of claim 10, further comprising:

an adjustable flow rate valve in the feed line to adjustably regulate the flow of the heated repair material through the feed line, said flow rate valve being opened to enable the pressurized air to blow asphalt in the feed line back into the storage tank.

12. The apparatus of claim 11, further comprising:

an air release valve coupled between the flush tank and a vent line, said release valve being opened to release pressurized air in the flush tank; and a return valve coupled between the flush tank and the recovery tank, said return valve being opened, causing cleaning agent collected in the recovery tank to return to the flush tank.

13. The apparatus of claim 12, further comprising:

the return valve between the flush tank and the recovery tank; and an air intake valve between a source of pressurized air and said flush tank, said air intake valve being opened to introducing air pressure into the flush tank in readiness for a subsequent flushing operation.

14. The apparatus of claim 10 wherein said air pressure line is coupled to an air brake device provided on said vehicle.

15. The apparatus of claim 10 wherein said second valve comprises:

a housing with common port which is selectively coupled to one of a plurality of ports arranged at spaced positions about said housing.

16. The apparatus of claim 15 wherein said second valve further comprises:

a rotatable operating handle movable to a plurality of given positions, each port of said plurality of ports being associated with one of said positions, whereby the common port is coupled to that port of the plurality of ports associated with the position to which the operating handle is moved.

17. Apparatus for collecting a cleaning agent used to flush a feed line for feeding asphalt from a source to a dispensing device, comprising:

a tank having an interior wall separating the tank into a recovery compartment and a flush compartment;

a flush valve coupled between said flush compartment and one end of said feed line;

an air pressure line coupled to the flush compartment through an inlet pressure valve;

a vent line coupled to said flush compartment by an air release valve;

said recovery compartment being selectively coupled to said feed line; and a poppet valve arranged in an opening in said interior wall and having a bias member to urge said poppet valve to a closed position, whereby the flush compartment, containing cleaning agent is pressurized when said inlet pressure valve is opened and said air release valve is closed, causing said poppet valve to close said opening; and a recovery valve coupled between said recovery compartment and another end of said feed line;

whereby pressurized cleaning agent in said flush compartment flows into said feed line and enters said recovery compartment when said flush valve and said recovery valve are opened, said poppet valve opening responsive to cleaning agent in the recovery compartment urging the poppet valve to open against the bias member and said air release valve is open to drain cleaning agent from the recovery compartment into the flush compartment when said vent valve is opened.

18. The apparatus of claim 17 wherein the poppet valve is closed by the bias member to seal the flush compartment when the air release valve is closed and the inlet pressure valve is opened to pressurize the flush compartment in readiness for a subsequent flush operation.

19. The apparatus of claim 17, further comprising:

a pressure gauge coupled to said flush compartment for monitoring the pressure in the flush compartment to control closing of the air release valve and opening of the inlet pressure valve.

20. The apparatus of claim 17, said poppet valve comprising a sealing member mounted in an opening in said interior wall and normally urged by the bias member comprising a spring member in a direction to lightly seal said opening and whereby liquid collected in said recovery compartment moves said sealing member against the light of the spring member spring force to an unsealed position when the flush compartment is depressurized to enable the liquid in the recovery compartment to return to the flush compartment.

21. The apparatus of claim 20 further comprising a gasket cooperating with the sealing member to enhance the air-tight seal.

22. The apparatus of claim 17, further comprising a threaded member supporting the poppet valve and configured to threadedly engage a tapped opening in the interior wall.

23. The apparatus of claim 22, said tank having a tapped access opening along its bottom end to facilitate insertion of said threaded member; and a threaded plug threadedly engaging said tapped access opening to seal said access opening.

24. The apparatus of claim 23 further comprising a gasket cooperating with said plug to air-tightly seal the access opening.

25. Apparatus for collecting a cleaning agent used to flush a feed line for feeding a material from a source to a dispensing device, comprising:

an air-tight tank having an interior wall separating the tank into a recovery compartment and a flush compartment;

the flush compartment having a first opening for selective coupling to one end of the feed line;

the flush compartment having a second opening for receiving air from a pressurizing source and a third opening for releasing pressure in the flush compartment;

said recovery compartment having a first opening to couple the recovery compartment to another end of the feed line for recovering the cleaning agent;

a poppet valve arranged in an opening in said interior wall, movable between a sealed and an unsealed position and normally biased to lightly seal said interior wall opening by a biasing member;

whereby the flush compartment, containing cleaning agent, is pressurized when air is introduced into the second opening of the flush compartment and the third opening of the flush compartment is closed;

the cleaning agent passing out of the flush compartment, through the feed line and collecting in the recovery compartment when the flush compartment first opening and the recovery compartment first opening are fluid-coupled to the feed line; and cleaning agent collected in the recovery tank exerts a force greater than said biasing member and returns to the flush compartment when the flush compartment is depressurized.

26. The apparatus of claim 25 wherein the recovery compartment is positioned above the flush compartment so that cleaning agent in the recovery compartment overcomes said light spring force to open the poppet valve enabling the cleaning agent to return to the flush compartment when the flush compartment is vented to the atmosphere.

27. For use by a wheeled unit for repairing roadway surfaces with a heated repair material, delivered from a storage tank through a first valve at an output of the storage tank, a feed line and second and third multi-position valves to selectively couple the feed line to first and second inputs of a mixing and dispensing head, a method for clearing and flushing the feed line, comprising:

a) moving the first valve to a first position coupling the feed line to the storage tank;

b) moving the second and third multi-position valves to a blowout position to couple a pressurized air line to the feed line, causing the heated repair material in the feed line to return to the storage tank;

c) moving the first valve to a second position decoupling the storage tank from the feed line and coupling the feed line to a flush tank containing a cleaning agent under pressure; and d) moving the second and third multi-position valves to a flush position decoupling the air line from the feed line and coupling the feed line to a recovery tank, whereby cleaning agent from the flush tank flushes the feed line and the second and third multi-position valves and is collected in the recovery tank for subsequent return to the flush tank.

28. The method of claim 27, further comprising:

moving the second and third multi-position valves to a feeding position to feed heated repair material to the first and second inputs of the mixing and dispensing head.

* * * * *